United States Patent [19]

Kauffman et al.

[11] 4,448,012

[45] May 15, 1984

[54] FORMING, FILLING AND SEALING MACHINE

[75] Inventors: Ivan L. Kauffman, Union Lake; Robert J. Allen, Farmington, both of Mich.

[73] Assignee: Ex-Cell-O Corporation, Troy, Mich.

[21] Appl. No.: 320,985

[22] Filed: Nov. 12, 1981

[51] Int. Cl.[3] ..... B65B 43/26

[52] U.S. Cl. ..... 53/563; 53/565; 53/266 R; 53/375

[58] Field of Search ..... 53/565, 563, 551, 552, 53/266 R, 276, 375; 493/142, 164, 134

[56] References Cited

U.S. PATENT DOCUMENTS 1,893,169 1/1933 Hartmann ..... 53/563
3,486,423 12/1969 Mistarz ..... 53/565 X
3,699,743 10/1972 King et al. ..... 53/565
4,262,470 4/1981 Reuter et al. ..... 53/551 X

*Primary Examiner*—Horace M. Culver
*Attorney, Agent, or Firm*—John P. Moran

[57] ABSTRACT

This disclosure illustrates and describes a liquid packaging machine including a base frame having a vertical keel mounted along the longitudinal centerline thereof. The units relating to forming blanks into cartons, filling the cartons with consumable liquids, and sealing the filled cartons, along with the required conveying means, are all mounted on one side of the keel, while the motor and related drive and indexing mechanisms are mounted on the other side of the keel, operatively connected to the forming, filling, sealing, and conveying means.

4 Claims, 5 Drawing Figures

10
12
14
16
18
18a
18b
18c
18d
18e
18f
18g
18h
18i
20
22
24
25
26
27
28
30
35
38
40
42
44
46
48
50
52
56
96
98
100

FORMING, FILLING AND SEALING MACHINE

TECHNICAL FIELD

This invention relates generally to liquid packaging machines and, more particularly, to the overall structural arrangement thereof.

Background Art

Heretofore, liquid packaging machines have satisfactorily included either a base frame below which the motor and drive means in general are mounted, and above which the forming, filling and sealing units in general are mounted (Allen U.S. Pat. No. 3,602,106 and Egleston U.S. Pat. No. 3,464,326); or a box-type frame between the side walls of which all of the motor and drive means and forming, filling and sealing units are mounted (Egleston et al U.S. Pat. No. 3,309,841); or a base frame below which the motor and drive means are mounted, and partial vertical support plates on which selected forming, filling and sealing units are supported while some of these units are mounted on the base frame (Egleston U.S. Pat. No. 3,195,781).

Disclosure of the Invention

An object of this invention is to provide a compact, efficient and sanitary frame and central longitudinal keel arrangement for a liquid packaging machine, wherein the units relating to the consumable liquids being packaged are mounted on one side of the keel, while the motor and various drive mechanisms are mounted on the other side of the keel.

Another object of the invention is to provide a machine structure which is rigid and substantially free from a need to level any of the four corners thereof.

A further object of the invention is to provide an improved frame and keel arrangement for a liquid packaging machine, wherein a vertical keel is secured to a base frame along the longitudinal centerline thereof, with forming, bottom sealing, filling, top sealing and conveying mechanisms supported on one side of the keel, and motor, drive shaft, speed reducer, indexing unit, timing cams, and related valve and conduit components supported on the other side thereof.

These and other objects and advantages of the invention will become more apparent when reference is made to the following description and accompanying drawings.

BEST MODE OF CARRYING OUT THE INVENTION

Figures 1, 1A:
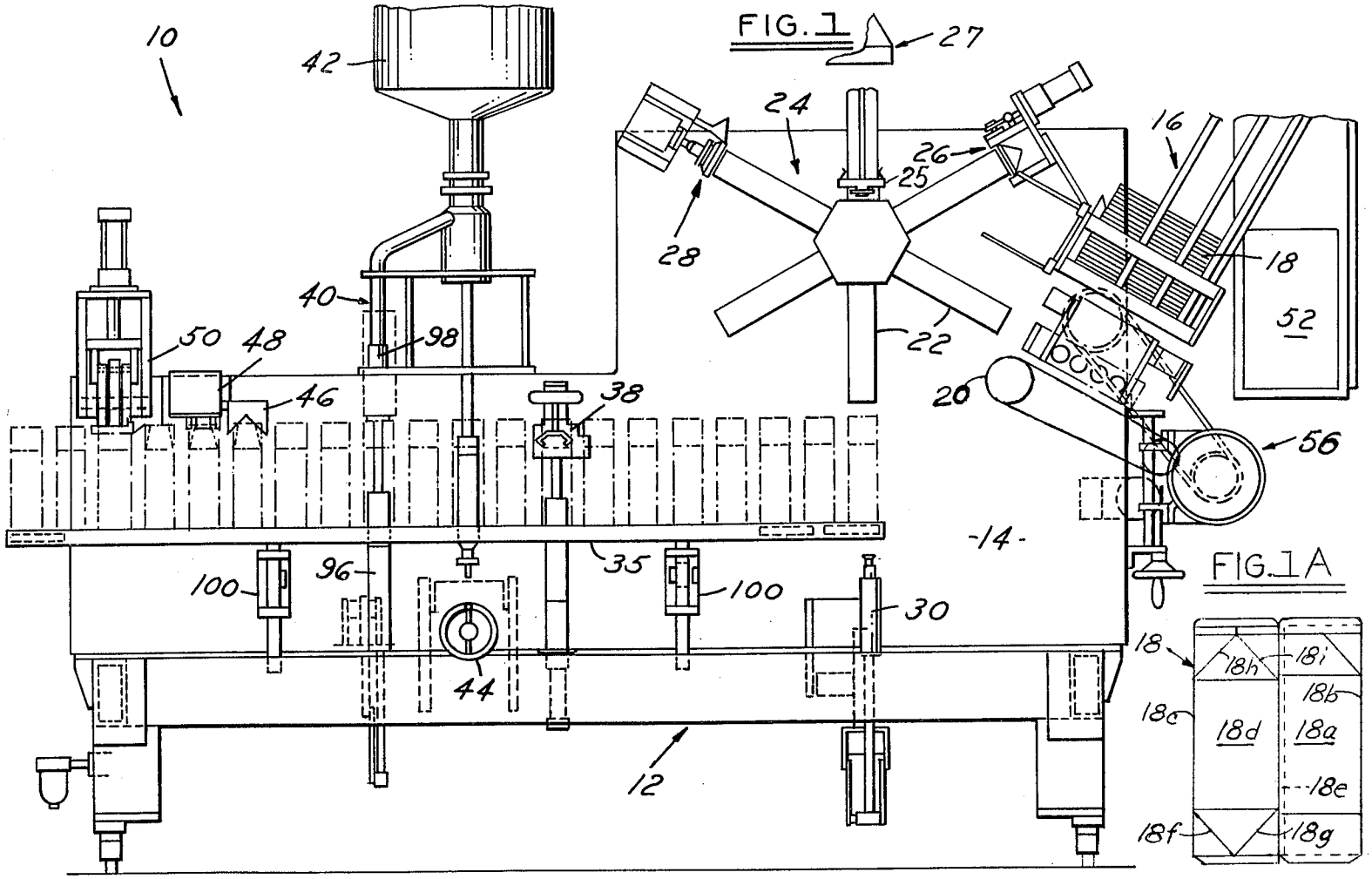
FIG. 1 is a side elevational view of a machine embodying the invention.
FIG. 1A is a layout view of a carton blank adapted to being processed on the FIG. 1 machine.
Figure 3:
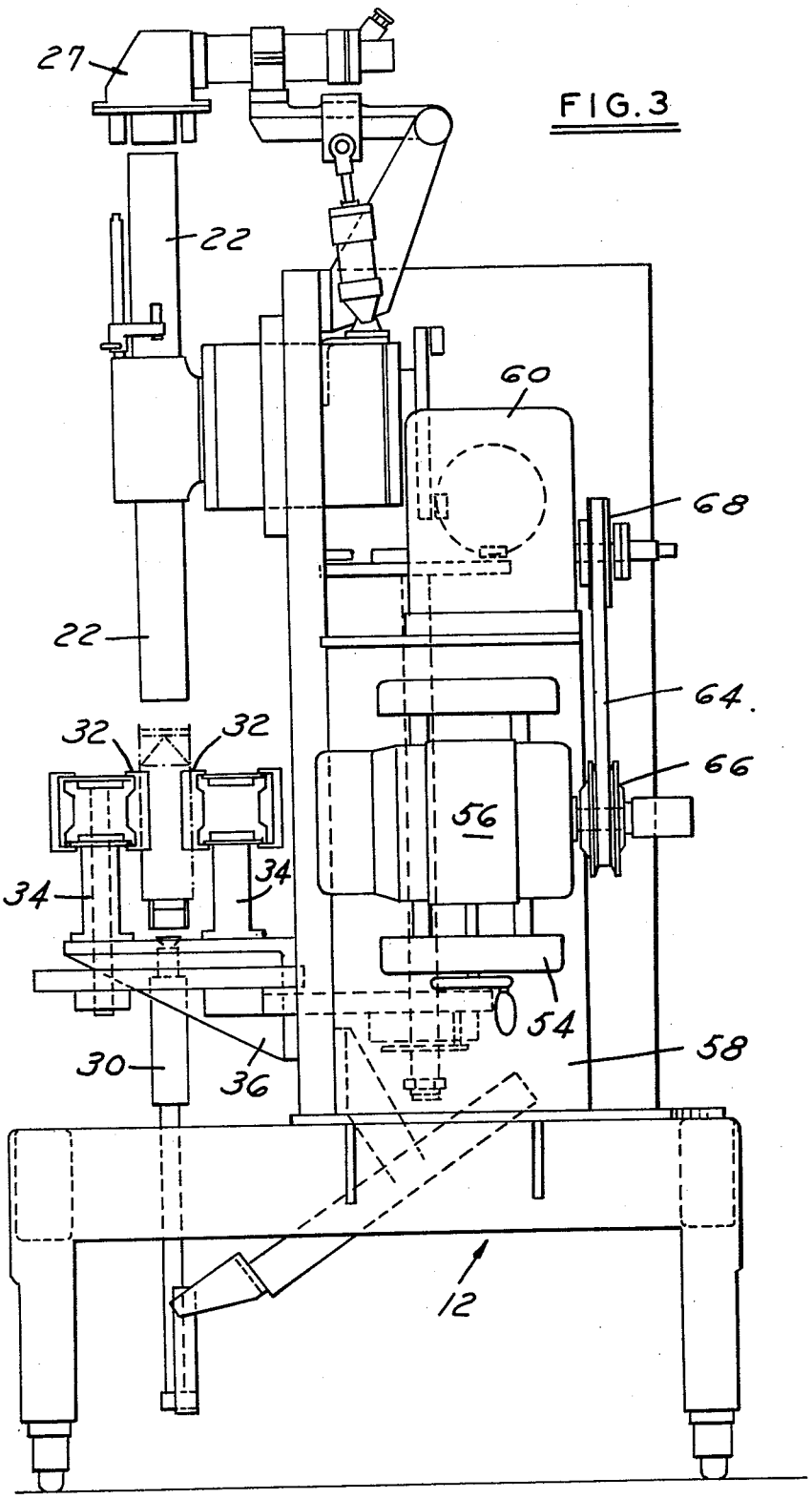
FIG. 3 is an end view of the FIG. 1 machine.
Figure 4:
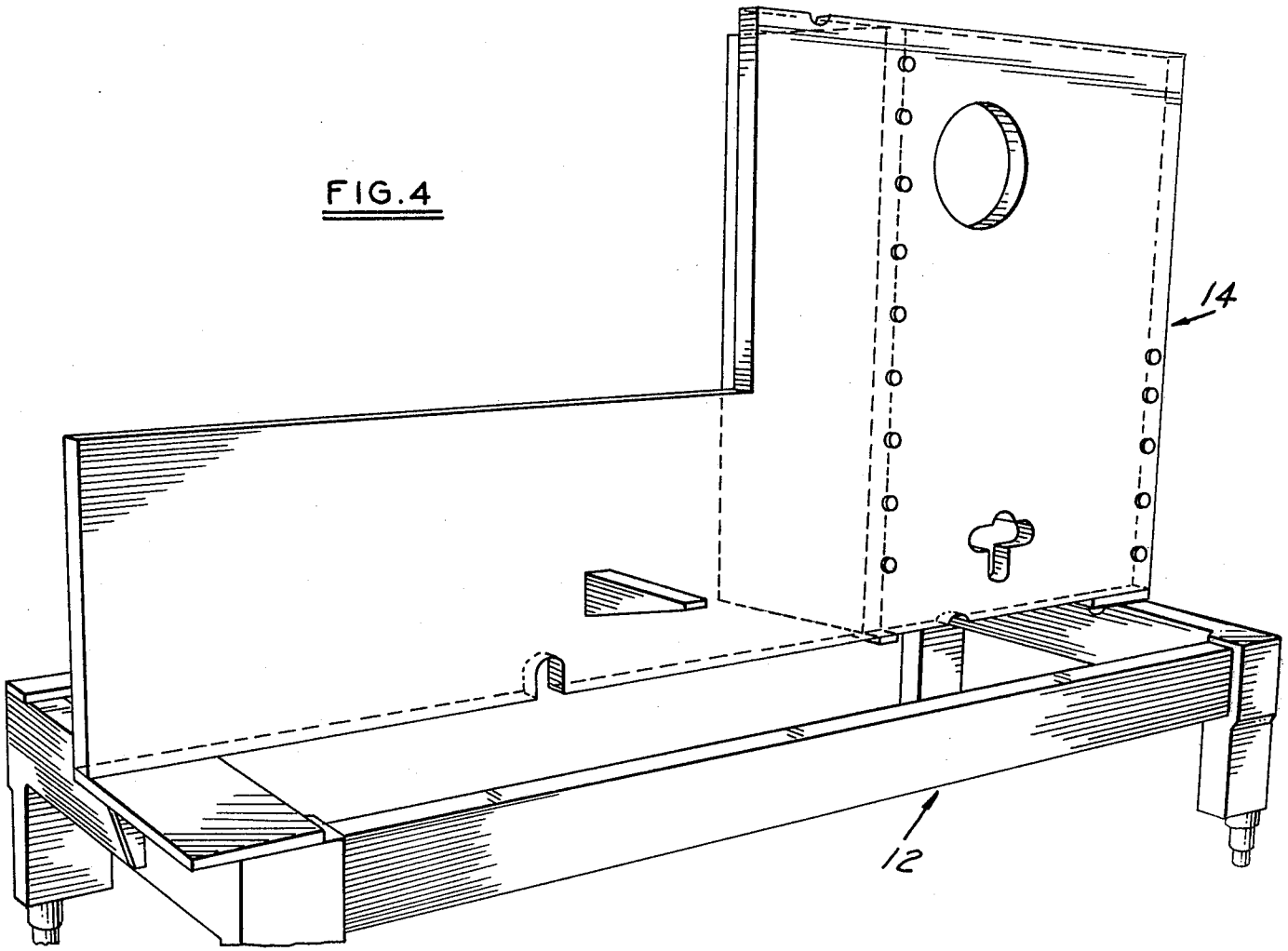
FIG. 4 is a perspective view of one side of the support structure of the FIG. 1 machine.
Figure 5:
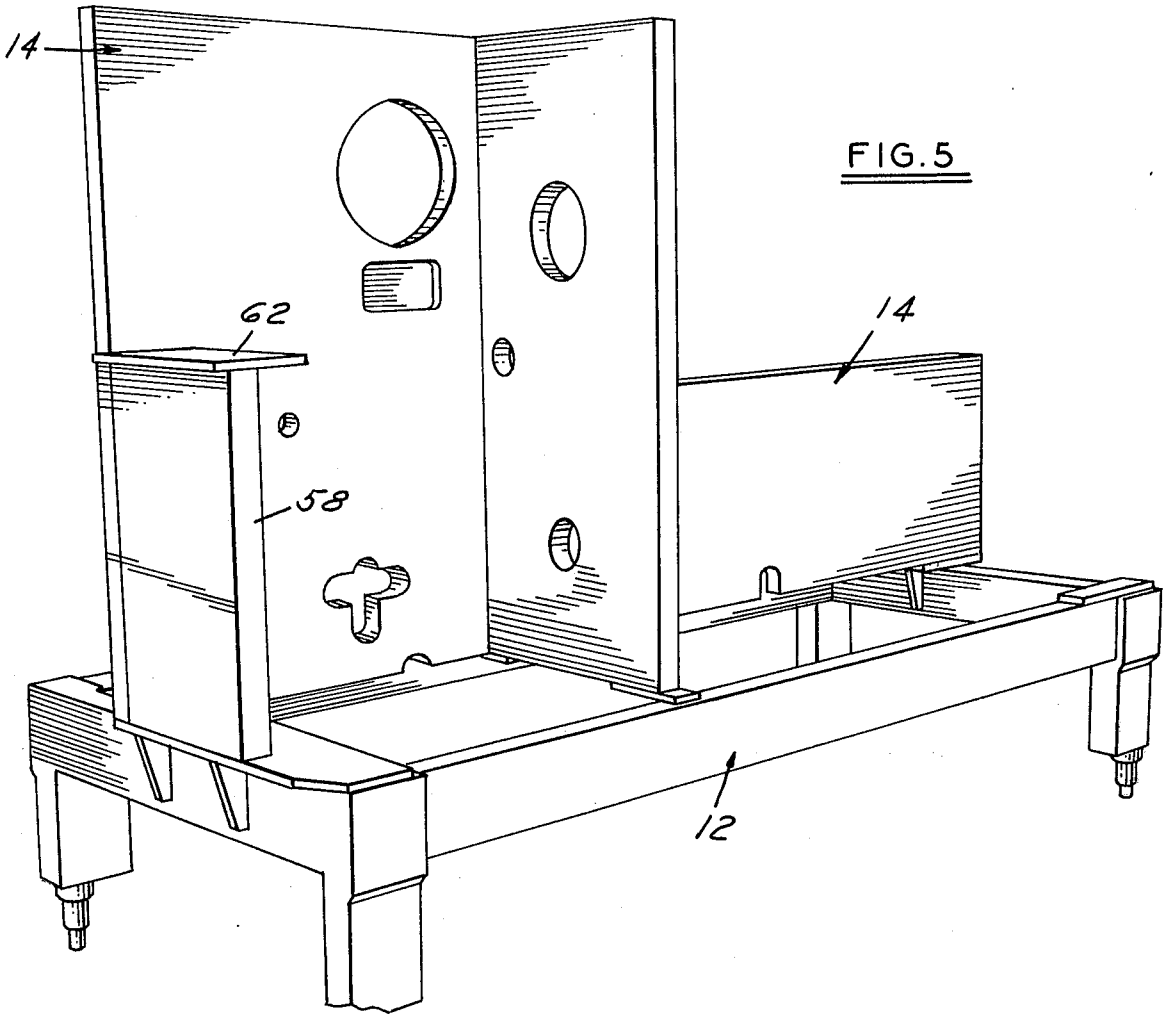
FIG. 5 is a perspective view of the other side of the FIG. 4 support structure.

Referring now to the drawings in greater detail, FIGS. 1 and 3 illustrate a forming, filling and sealing machine 10 of the liquid packaging type, including a base frame 12, and a vertical support keel 14 mounted along the longitudinal axis of the frame. The frame and keel are best shown in FIG. 5. The loading, forming, filling and sealing components are mounted on one side of the keel 14 as follows:

A magazine 16 for holding a plurality of paperboard blanks 18 is mounted on one side of one end of the keel. The blanks 18 are illustrated in FIG. 1A as having four full width side panels 18*a*, 18*b*, 18*c* and 18*d*, and a side seam flap 18*e*, with the panels 18*b* and 18*c* being folded behind the panels 18*a* and 18*d*, respectively, and the flap 18*e* sealed the inner edge portion of the panel 18*a*. A loading mechanism 20 is mounted on the keel just below the magazine 16 and adapted to withdraw one blank at a time while opening same into a four-sided tube and loading such individual tube onto one of six mandrels 22 of an indexable turret mechanism 24. The latter is rotatably mounted on an upper portion of the keel 14. The receiving mandrel is positioned at 4:00 o'clock when a paperboard tube is slid thereon by the loading mechanism 20. An adjustable stop member 25 is operatively connected to each mandrel 22.

The mandrel indexes counterclockwise in FIG. 1 to a 2:00 o'clock position where two of the usual four bottom closure panels of the tube are pre-broken along performed score lines 18*f* and 18*g* (FIG. 1A) by a prebreaker unit 26. At the 12:00 o'clock position, the four bottom closure panels are heated by a suitable heater 27 mounted on the other side (FIG. 3) of the keel 14 and extending over the upper edge thereof above the 12:00 o'clock mandrel. The bottom heated tube and mandrel 22 are next indexed to a 10:00 o'clock position where a closing and sealing unit 28 closes the bottom panels into an overlapped flat configuration and, under pressure, seals the overlapped panels together, changing the tube into a bottom sealed container or carton suitable for containing a liquid. Thereafter the bottom sealed carton is indexed to an 8:00 o'clock position where it continues to cool, prior to being indexed to an unloading 6:00 o'clock position.

At the latter position, the carton is stripped from the mandrel 22 by a stripping unit 30 and pulled downwardly between oppositely disposed retainer members 32 (FIG. 3) of a pair of parallel endless conveyors 34 to rest on a stationary rail 35. As may be noted in FIG. 3, the conveyors 34 are supported on brackets 36 mounted on one side of the keel 14, and the stripping unit 30 is mounted on the other side of the keel 14, and extended beneath the keel and then upwardly between the pair of conveyors. As the conveyors index leftward in FIG. 1, the rotation of the turret mechanism 24 is coordinated with the movement of the conveyors so as continuously to supply bottom sealed cartons at regular intervals to the conveyors. After a predetermined number of indexes, each carton is positioned beneath a top prebreaker unit 38 where the two oppositely disposed panels are pre-broken along their respective gable-shaped infold score lines 18*h* and 18*i* (FIG. 1A).

Each carton is next indexed into position beneath a filling unit 40 which feeds a measured volume of a particular liquid, such as milk, from a source 42 into the carton. The volume per carton is controlled by a fill calibration device 44 operatively connected to the filling unit 40. As the carton indexes therefrom, its gable type top is heated, folded, and sealed by respective folding, heating, and sealing units 46, 48 and 50 mounted on the keel 14. Thereafter, at the end of the forward travel of the endless conveyors 34, the closed carton is discharged onto any suitable track unit (not shown) to be readied for shipment.

Figure 2:
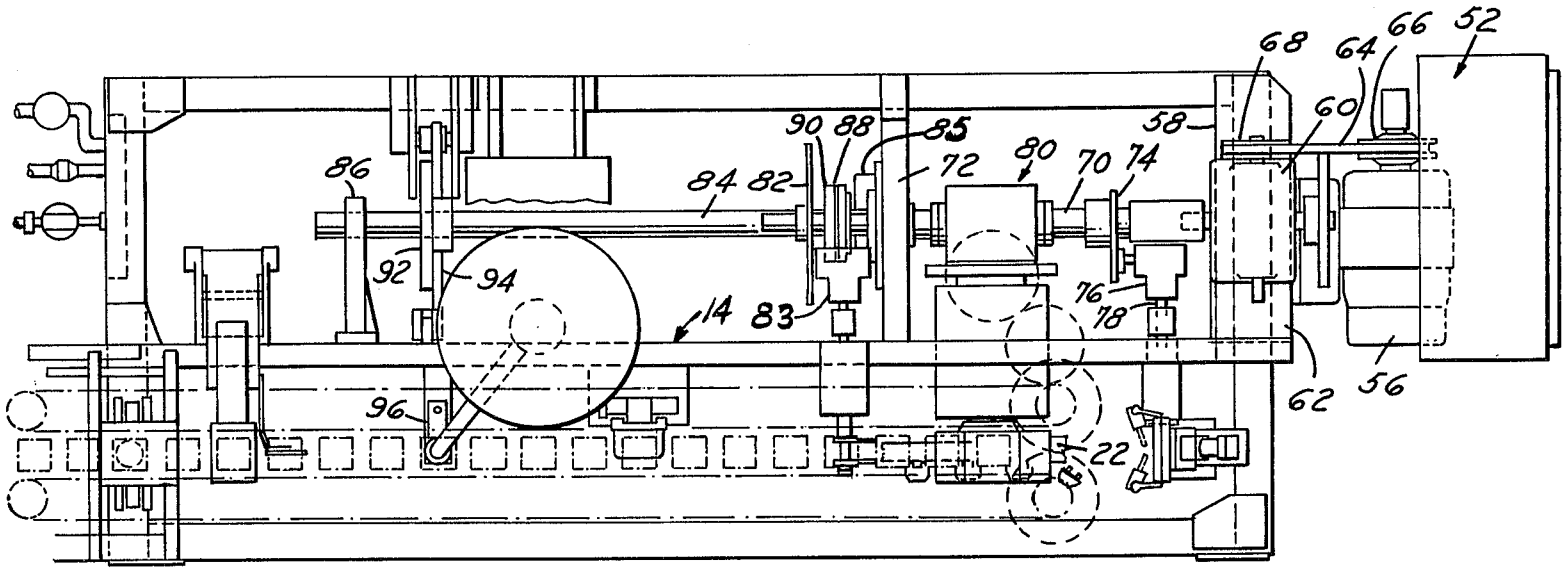
FIG. 2 is a plan view of the FIG. 1 machine.

Referring now to FIG. 2, it may be noted that the operating mechanisms for driving the various units referred to above are mounted on the side of the keel 14 opposite the various forming, filling, and sealing stations. More specifically, a control box 52 is located adjacent one end of the machine 10 and may be supported thereon. A variable speed take-up unit 54 (FIG. 3) and an electric drive motor 56 are mounted on a first bulkhead 58 supported on the framework 12 and the side of the keel 14 opposite the above described forming, filling and sealing units. A worm gear drive unit 60 is mounted on a support plate 62 secured to the top of the bulkhead 58. A drive belt 64 is mounted around pulleys 66 and 68 on the respective outer ends of the motor 56 and drive unit 60. A front or upper drive shaft 70 is operative between the drive unit 60 and a second bulkhead 72. The bulkheads 58 and 72 and their relationships with the keel 14 are best shown in FIG. 5. A sprocket 74 is mounted on the drive shaft 70 for driving a right angle gear box unit 76 which, in turn, operates a shaft 78 rotatably mounted through the keel 14 to drive the loader mechanism 20. An indexing cam unit 80 is also mounted on the upper shaft 70 and operatively connected through the keel 14 for coordinating the indexing of the six mandrel turret 24 and the conveyors 34. A sprocket 82 is mounted on the portion of the upper shaft 70 which extends through the bulkhead 72 and drives a right angle gear box 83, which in turn, drives the rotary closing portion of the closing and sealing unit 28.

A rear or lower drive shaft 84 has one end thereof rotatably supported via mounting means 85 on the bulkhead 72, with the other end thereof rotatably supported on a support plate 86 secured to the keel 14. A chain drive 88 is operatively connected between a pair of sprockets represented as 90, mounted on the respective upper and lower shafts 70 and 84 for driving the latter. A timing cam 92 for actuating the filler unit 40 is mounted on the lower shaft 84, as is a cam 94 for actuating a carton lifter 96. The latter raises each carton, as shown in phantom in FIG. 1, around a nozzle 98 of the filler unit 40 to accomodate a "bottom-up" filling operation therebetween. Suitable jack mechanisms, represented as 100 in FIG. 1, may be mounted between the base frame 12 and the stationary rail 35 for raising and lowering the latter, as required, to accomodate short and tall bottom sealed cartons, i.e., half pint and quart sizes, as received from the 6:00 o'clock mandrel 22. Other cams as required (not shown) may be selectively mounted on the shafts 70 and 84 for actuating various valves (not shown) which may be required for the hydraulic system, and which may be mounted on the keel and/or the frame.

INDUSTRIAL APPLICABILITY

The overall operation of the packaging machine 10 is deemed to be apparent from the above description of the various components. It should also be apparent that the frame, keel, and bulkhead structure provides a compact, efficient and sanitary arrangement for carrying, out the forming, filling, and sealing of liquid-carrying thermoplastic-coated paperboard cartons.

It should be further apparent that the frame and central keel arrangement provides maximum protection for both the product and the various drive units, and that access for maintenance is simplified in that the various sub-assemblies on both sides of the keel 14 may be serviced by an operator while in a standing position.

In addition, it should be noted that the above described machine is adaptable to having a second stream of cartons processed thereon concurrently with the single stream shown and described. This is accomplished by adding a second set of conveyors adjacent and parallel to the first pair of conveyors, extending the turret shaft to accomodate a second six mandrel turret, while adding a second magazine, pre-breaker, filler unit, and closing and sealing mechanism, all supported on the framework 12 and single keel structure 14.

While but one embodiment of the invention has been shown and described, other modifications thereof are possible.

The embodiments of the invention in which an exclusive property or privilege is claimed are:

1. A forming, filling and sealing machine comprising a base frame, a single vertical keel, said single vertical keel being secured along the longitudinal centerline of said base frame and having forming means mounted on one side thereof for forming side seam sealed blanks into rectangular tubes, bottom sealing means mounted on said one side thereof for sealing the bottoms of said tubes into open topped cartons, filler means mounted on said one side thereof for filling said open topped cartons with a liquid, top sealing means mounted on said one side thereof for sealing the tops of said filled cartons, and conveyor means mounted on said one side thereof for conveying said cartons; said vertical keel also having driving and indexing means mounted on the other side thereof and operatively connected to said forming, filler, sealing and conveying means for actuating means.

2. A forming, filling and sealing machine comprising a base frame, a single vertical keel, said single vertical keel being secured along the longitudinal centerline of said base frame and having a turret rotatably mounted on one side thereof, forming and loading means mounted on said one side thereof for forming side seam sealed blanks into rectangular tubes and loading said tubes onto said turret, bottom sealing means mounted on said one side thereof for sealing the bottoms of said tubes into open topped cartons, conveyor means mounted on said one side thereof for conveying said cartons, filler means mounted on said one side thereof for filling said open topped cartons with a liquid, and top sealing means mounted on said one side thereof for sealing the tops of said cartons; said vertical keel also having stripping means mounted on the other side thereof and extending beneath said keel so as to remove said cartons from said turret and transfer same to said conveyor means, and driving and indexing means mounted on said other side thereof and operatively connected to said forming and loading, filler, sealing, conveying, and transfer means for actuating same.

3. A forming, filling and sealing machine comprising a base frame, a single vertical keel, said single vertical keel being secured along the longitudinal centerline of said base frame, conveyor means operatively mounted on one side of said vertical keel, first and second bulkheads secured at spaced intervals to said base frame and to the other side of said vertical keel, a power source and drive means rotatably mounted between said first and second bulkheads, indexing means operatively connected to said drive means and through said vertical keel to actuate said conveyor means, a magazine mounted on said one side of said vertical keel for holding cartons blanks, loader means mounted on said one side of said vertical keel for opening said carton blanks into tubes, cam means operatively connected to said drive means for actuating said loader means, bottom sealing means mounted on said one side of said vertical keel for sealing the bottom closure of said tubes to form open-topped cartons, transfer means mounted on said keel for transferring said open-topped cartons from said bottom sealing means to said conveyor means, filler means mounted on said one side of said vertical keel for filling said open-topped cartons, timing means operatively connected to said drive means for actuating said filler means in timed relationship with the movement of said conveyor means, and top sealing means mounted on said one side of said vertical keel for sealing the top closure of said filled cartons.

4. A forming, filling and sealing machine comprising a base frame, a single vertical keel, said single vertical keel being secured along the longitudinal centerline of said base frame, a turret and conveyor means operatively mounted on one side of said vertical keel, first and second bulkheads secured at spaced intervals to said base frame and to the other side of said vertical keel, an electric motor mounted on said first bulkhead, a first drive shaft rotatably mounted between said electric motor and said second bulkhead, indexing cam means operatively connected to said first drive shaft and through said vertical keel to cooperatively actuate said turret and said conveyor means, a magazine mounted on said one side of said vertical keel for holding carton blanks, loader means mounted on said one side of said vertical keel for removing individual blanks from said magazine, opening same into rectangular tubes, and loading said tubes onto said turret, cam means operatively connected to said first drive shaft for actuating said loader means, first pre-breaking and sealing means mounted on said one side of said vertical keel for sealing the bottom closure of said tubes on said turret to form open-topper cartons, stripping means mounted on said keel for stripping said open-topped cartons from said turret and placing same in position on said conveyor means, a vertical support plate secured to said other side of said vertical keel apart from said second bulkhead, a second drive shaft extending between said second bulkhead and said vertical support plate, connector means operatively connected between said first and second drive shafts, filler means mounted on said one side of said vertical keel, timing cam means operatively connected to said second drive shaft for actuating said filer means in timed relationship with movement of said conveyor means, and second pre-breaking and sealing means mounted on said one side of said vertical keel for sealing the top closure of said filled cartons.

* * * * *